US007151421B2

(12) United States Patent
Shinabe et al.

(10) Patent No.: US 7,151,421 B2
(45) Date of Patent: Dec. 19, 2006

(54) COUPLER

(75) Inventors: Munehiro Shinabe, Nihama (JP); Yasushi Ono, Saijo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 28 days.

(21) Appl. No.: 10/502,716

(22) PCT Filed: Jul. 1, 2003

(86) PCT No.: PCT/JP03/08347

§ 371 (c)(1),
(2), (4) Date: Jul. 29, 2004

(87) PCT Pub. No.: WO2004/006383

PCT Pub. Date: Jan. 15, 2004

(65) Prior Publication Data

US 2005/0140463 A1 Jun. 30, 2005

(30) Foreign Application Priority Data

Jul. 5, 2002 (JP) ..... 2002-197505

(51) Int. Cl.
*H01P 3/08* (2006.01)
*H01P 5/18* (2006.01)

(52) U.S. Cl. ..... 333/116; 333/128

(58) Field of Classification Search ..... 333/109, 333/116, 127, 128
See application file for complete search history.

(56) References Cited

U.S. PATENT DOCUMENTS

| | | | | |
|---|---|---|---|---|
| 3,886,498 | A * | 5/1975 | Mosko et al. | 333/128 |
| 4,150,345 | A * | 4/1979 | Goldman et al. | 333/116 |
| 4,916,417 | A | 4/1990 | Ishikawa et al. | 333/204 |
| 5,012,209 | A * | 4/1991 | Lantagne et al. | 333/116 |
| 5,446,425 | A | 8/1995 | Banba | 333/116 |
| 5,576,669 | A | 11/1996 | Ruelke | 333/116 |
| 5,767,753 | A | 6/1998 | Ruelke | 333/116 |
| 6,566,988 | B1 | 5/2003 | Muzutani et al. | 333/219 |
| 6,768,401 | B1 * | 7/2004 | Koriyama | 333/248 |
| 6,906,598 | B1 * | 6/2005 | Roberson et al. | 333/24 R |

FOREIGN PATENT DOCUMENTS

| | | |
|---|---|---|
| EP | 0 437 115 A | 7/1991 |
| JP | 62-130001 | 6/1987 |
| JP | 62-263702 | 11/1987 |
| JP | 5-267907 | 10/1993 |
| JP | 6-350313 | 12/1994 |
| JP | 7-142903 | 6/1995 |
| JP | 10-79608 | 3/1998 |
| JP | 10135717 | 5/1998 |
| JP | 2001-230610 | 8/2001 |

* cited by examiner

*Primary Examiner*—Dean Takaoka
(74) *Attorney, Agent, or Firm*—Wenderoth, Lind & Ponack, L.L.P.

(57) ABSTRACT

The present invention provides a coupler having a high degree of coupling. The coupler comprises first and second dielectric substrates each having first and second surfaces which are parallel to each other. A ground conductor is formed on the first surface of the first dielectric substrate, and two coupling line conductors and are formed on the second surface of the second dielectric substrate close to each other so as to be electromagnetically coupled to each other. Via conductors and are filled in through holes passing through the second dielectric substrate, and are placed and connected to the two coupling line conductors so as to enhance the degree of electromagnetic coupling, thereby increasing the opposing areas between the coupling line conductors to increase the capacitance.

39 Claims, 7 Drawing Sheets

Fig.6 (c) PRIOR ART

COUPLER

TECHNICAL FIELD

The present invention relates to couplers. More specifically, this invention relates to directional couplers in microwave circuits or couplers to be used for filters and, more particularly, to couplers which provide high degrees of coupling in cases of using striplines.

BACKGROUND ART

Conventionally, couplers have been used for various microwave circuits, such as filter circuits, balanced amplifiers, balanced mixer, and baluns.

FIGS. 6(*a*) through 6(*g*) are diagrams showing a coupler that employs conventional ¼-wavelength end short-circuited type coupling lines.

FIG. 6(*c*) is a top plan view showing a conventional coupler, in which parts that are not seen from the top are indicated by dashed lines. FIG. 6(*a*) is a longitudinal sectional view of the coupler along line A9–A10 of FIG. 6(*c*). FIG. 6(*b*) is a longitudinal sectional view thereof along line A11–A12 of FIG. 6(*c*). FIG. 6(*d*) is a transverse sectional view thereof along line A1–A2 of FIG. 6(*c*). FIG. 6(*e*) is a transverse sectional view thereof along line A3–A4 of FIG. 6(*c*). FIG. 6(*f*) is a transverse sectional view thereof along line A5–A6 of FIG. 6(*c*). FIG. 6(*g*) is a transverse sectional view thereof along line A7–A8 of FIG. 6(*c*).

As shown in FIGS. 6(*a*) and 6(*b*), the conventional coupler includes a ground conductor 603 that is formed on an under surface of a first dielectric substrate 601, and a ground conductor 604 that is formed on a top surface of a second dielectric substrate 602.

Further, as shown in FIGS. 6(*e*) and 6(*f*), between the first dielectric substrate 601 and the second dielectric substrate 602, there are formed signal input/output line conductors 612 and 613 that employ striplines, and two coupling line conductors 620 and 621 that are adjacent to each other so as to be electromagnetically coupled, in symmetry with respect to the center line of the ground conductor 604.

In addition, via conductors 630, 631, 632 and 633 are filled in through holes that pass through the first dielectric substrate 601 and the second dielectric substrate 602.

As shown in FIGS. 6(*a*) and 6(*b*), the via conductors 630, 631 and the via conductors 632, 633 short-circuit not-opposing end portions of the coupling line conductors 620 and 621 to the ground conductors 604 and 603 at a position of line A7–A8 of FIG. 6(*c*) and at a position of line A1–A2 of FIG. 6(*c*), respectively, thereby providing inter-digital coupling.

Further, on the side surfaces of the first dielectric substrate 601 and the second dielectric substrate 602, ground conductors 605, 606, 607, and 608 are formed.

As described above, the conventional coupler utilizing the ¼-wavelength end short-circuited type coupling lines is formed using the striplines, with the coupling line conductors 620 and 621 being enclosed with the ground conductors 603, 604, 605, 606, 607, and 608.

The conventional coupler utilizing the ¼-wavelength end short-circuited type coupling lines connects the signal input/output line conductors 612 and 613 to the coupling line conductors 620 and 621 symmetrically with respect to a point in such a manner that the conductors 612 and 613 are not opposing to each other, and an input/output impedance is decided from a distance from the connecting point to the end of the coupling line conductor 620 or 621.

Signal input/output end face electrodes 610 and 611 at the mounting on a printed circuit board are formed on the side surfaces of the first dielectric substrate 601 and the second dielectric substrate 602, and are connected to the signal input/output line conductors 612 and 613, respectively.

Here, the coupling line conductors 620 and 621 each have a length along the length, corresponding to a ¼ wavelength, i.e., a longitudinal length corresponding to ¼ λg (λg is an intra-tube wavelength).

When an analysis is performed on the conventional coupler utilizing the ¼-wavelength end short-circuited type coupling lines, using quasi-TEM approximation based on a known even/odd orthogonal mode excitation method (J. Reed) or using an analyzing method in an even or odd mode, which is disclosed by "Practical Use, Lectures on microwave technology—Theory and Fact—Volume 3, June 2001 (written by Yoshihiro Konishi, published by K-Laboratory)", in-phase excitation occurs in the even mode while opposite-phase excitation occurs in the odd mode.

In this case, characteristic impedances Zodd and Zeven of coupling transmission lines of the coupling lines in the odd and even modes are represented by [Formula 1] and [Formula 2].

[Formula 1]

$$Zodd=1/(Vp\times(C1+2\times C12))[\Omega]$$

[Formula 2]

$$Zeven=1/(Vp\times C1)[\Omega]$$

Here, Vp is a speed at which the electromagnetic field propagates through a transmission line. C1 is a capacitance per unit length between the coupling line conductors 620 and 621 (striplines) and the ground conductors 603 and 604, and C12 is a capacitance per unit line between the coupling line conductors 620 and 621.

The degree K of coupling of the conventional coupler that utilizes the ¼-wavelength end short-circuited type coupling lines can be expressed by a following formula, using the characteristic impedances Zodd and Zeven.

[Formula 3]

$$K=20\log\{(Zeven-Zodd)/(\sqrt{2}\times(Zeven+Zodd))[dB]$$

By substituting [Formula 1] and [Formula 2] into [Formula 3], following [Formula 4] indicating the coupling degree K is obtained.

[Formula 4]

$$K=20\log\{C12/(\sqrt{2}\times(C1+C12))\}$$

Thus, the coupling degree K of the conventional coupler that utilizes the ¼-wavelength end short-circuited coupling line is represented as described above.

However, in the above-mentioned conventional coupler utilizing the striplines, it is possible to increase the coupling degree K only by extremely reducing the spacing between two coupling line conductors 620 and 621. But, the minimum spacing between the two coupling line conductors 620 and 621 is limited from the viewpoint of manufacturing.

Recently, a low-temperature co-fired ceramic (LTCC) has been developed, whereby it has become possible to thin an insulating layer and miniaturize the coupler. However, when the insulating layer is thinned, the capacitance C1 per unit length between the coupling line conductors 620 and 621 as the striplines, and the ground conductors 603 and 604 is increased. Accordingly, the coupling degree K of the coupling line is further reduced as expressed by [Formula 4].

To solve this problem, Japanese Patent Application No. Hei. 05-135749 (Japanese Published Patent Application No. Hei. 06-350313) suggests a ¼-wavelength coupling line type directional coupler which is obtained by improving the above-mentioned conventional coupler.

The prior art as disclosed in this publication relates to line conductors mainly using microstrips, but it is easily affected by electromagnetic interference from outside, and further, components cannot be placed above or below the ¼-wavelength coupling line directional coupler, so that it is not suitable for high-density packaging and cannot be miniaturized.

The present invention is made to overcome the above-mentioned conventional problems, and has for its object to provide a coupler having a higher coupling degree K, which is smaller in size and allows higher-density packaging with relative to the prior art.

SUMMARY OF THE INVENTION

To overcome the conventional problems, according to a first aspect of the present invention, there is provided a coupler comprising: a first dielectric substrate having a first surface and a second surface which are parallel to each other; a second dielectric substrate having a first surface and a second surface which are parallel to each other, the second dielectric substrate being placed on the second surface of the first dielectric substrate; a ground conductor that is formed on the first surface of the first dielectric substrate; two coupling line conductors each having a length of a ¼ wavelength, the coupling line conductors being close to each other on the second surface of the second dielectric substrate so as to be electromagnetically coupled to each other; and plural via conductors which are filled in plural through holes passing through the second dielectric substrate and are placed and connected to the two coupling line conductors.

According to the present invention, the opposing areas between the coupling line conductors are increased in the odd mode by an amount that is larger than an increase in the capacitance between the coupling line conductor and the ground conductor in the even mode, thereby increasing the degree of coupling of the coupler.

According to a second aspect of the present invention, in the coupler as defined in the first aspect, a third dielectric substrate having a first surface and a second surface which are parallel to each other is formed on the second surface of the second dielectric substrate, and a ground conductor is formed on the second surface of the third dielectric substrate.

According to the present invention, as the coupler is enclosed with the ground conductors, the coupler has resistance to electromagnetic interference from outside, whereby it is possible to place the components at high densities, resulting in a miniaturized apparatus.

According to a third aspect of the present invention, in the coupler as described in the first aspect, via conductors that are filled in through holes passing from the first dielectric substrate to the second dielectric substrate are provided, and the via conductors that are filled in the through holes passing through the two substrates short-circuit ends of the two coupling line conductors, which are not opposing to each other, to the ground conductor that is formed on the first surface of the first dielectric substrate, thereby providing inter-digital coupling.

According to the present invention, it is possible to form an inter-digital filter.

According to a fourth aspect of the present invention, in the coupler as described in the second aspect, via conductors that are filled in through holes passing from the first dielectric substrate to the third dielectric substrate are provided, and the via conductors that are filled in the through holes passing through the three substrates short-circuit ends of the two coupling line conductors, which are not opposing to each other, to the ground substrates that are formed on the first surface of the first dielectric substrate and the second surface of the third dielectric substrate, thereby providing inter-digital coupling.

According to the present invention, it is possible to form an inter-digital filter.

According to a fifth aspect of the present invention, in the coupler as described in the third or fourth aspects, the via conductors that are filled in the through holes passing through the two or three substrates short-circuit opposing ends of the two coupling line conductors to the ground conductor that is formed on the first surface of the first dielectric substrate, or to the ground conductors that are formed on the first surface of the first dielectric substrate and the second surface of the third dielectric substrate, thereby providing comb-line coupling.

According to the present invention, it is possible to form a comb-line filter.

According to a sixth aspect of the present invention, in the coupler as described in any of aspects 3 to 5, the plural via conductors that are filled in the plural through holes passing through the second dielectric substrate are placed and connected to the two coupling line conductors at regular intervals.

According to the present invention, it is possible to place the via conductors uniformly at high densities.

According to a seventh aspect of the present invention, in the coupler as described in any of aspects 3 to 5, the plural via conductors that are filled in the plural through holes passing through the second dielectric substrate are placed and connected to the two coupling line conductors in a straight line along the length.

According to the present invention, it is possible to place the via conductors on the coupling line conductors uniformly at high densities.

According to an eighth aspect of the present invention, in the coupler as described in any of aspects 3 to 5, the plural via conductors that are filled in the plural through holes passing through the second dielectric substrate are placed and connected to the opposing two coupling line conductors, respectively, on a part which is closer to a line intermediate between the two coupling line conductors.

According to the present invention, it is possible to obtain a higher degree of coupling by placing the opposing many high-density via conductors as close as possible to each other.

According to a ninth aspect of the present invention, in the coupler as described in any of aspects 3 to 5, the plural via conductors that are filled in the plural through holes passing through the second dielectric substrate are placed and connected to the opposing two coupling line conductors, respectively, on a part which is closer to a line intermediate between the two coupling line conductors at regular intervals in a straight line along the length.

According to the present invention, it is possible to obtain a higher degree of coupling by placing the opposing many high-density via conductors as close as possible to each other.

According to aspect 10 of the present invention, in the coupler as described in any of aspects 3 to 5, the plural via conductors that are filled in the plural through holes passing through the second dielectric substrate are placed and connected to the two coupling line conductors so as to form thin parts and dense parts.

According to the present invention, it is possible to place the via conductors on parts of the coupling line conductors at high densities.

According to aspect 11 of the present invention, in the coupler as described in any of aspects 3 to 5, the plural via conductors that are filled in the plural through holes passing through the second dielectric substrate are placed and connected to the two coupling line conductors in such a manner that dense parts each being composed of a group of the via conductors are placed intermittently.

According to the present invention, the opposing areas between the coupling line conductors are increased in the odd mode by an amount that is larger than an increase of the capacitance between the coupling line conductor and the ground conductor in the even mode, thereby increasing the degree of coupling of the coupler.

According to aspect 12 of the present invention, in the coupler as defined in aspect 11, the plural via conductors that are filled in the plural through holes passing through the second dielectric substrate are placed and connected to the opposing two coupling line conductors, respectively, on a part which is closer to a line intermediate between the two coupling line conductors in a straight line along the length.

According to the present invention, it is possible to obtain a higher degree of coupling by placing the opposing many high-density via conductors as close as possible to each other.

According to aspect 13 of the present invention, in the coupler as described in any of aspects 3 to 5, the plural via conductors that are filled in the plural through holes passing through the second dielectric substrate are placed and connected to the two coupling line conductors in a zigzag manner so that the via conductors are opposing to each other.

According to the present invention, it is possible to enlarge the spacing between the via conductors and, especially in LTCC, it is possible to avoid cracks due to a warp that occurs in the dielectric substrate as an insulator. Further, the opposing areas between the coupling line conductors are increased in the odd mode by an amount that is larger than an increase in the capacitance between the coupling line conductor and the ground conductor in the even mode, thereby increasing the degree of coupling of the coupler.

According to aspect 14 of the present invention, in the coupler as described in any of aspects 3 to 5, the plural via conductors that are filled in the plural through holes passing through the second dielectric substrate are placed and connected to the two coupling line conductors in a staggered manner so that the via conductors are opposing each other.

According to the present invention, it is possible to enlarge the spacing between the via conductors and, especially in LTCC, it is possible to avoid cracks due to a warp that occurs in the dielectric substrate as an insulator. Further, the opposing areas between the coupling line conductors are increased in an odd mode by an amount that is larger than an increase in the capacitance between the coupling line conductor and the ground conductor in the even mode, thereby increasing the degree of coupling of the coupler.

According to aspect 15 of the present invention, in the coupler as described in any of aspects 3 to 5, two second line conductors are further provided between the second surface of the first dielectric substrate and the first surface of the second dielectric substrate, and the two coupling line conductors and the two second line conductors are conducting individually, and plural via conductors that are filled in the plural through holes passing through the second dielectric substrate are sandwiched between and connected to the coupling line conductor and the second line conductor, respectively.

According to the present invention, it is possible to enlarge the spacing between the via conductors, thereby increasing the coupling degree K of the coupling line. When this coupler is employed for a band-pass filter, it is possible to increase the passband, and realize a high-density packaging of multiple layers.

According to aspect 16 of the present invention, in the coupler as described in aspect 9, two second line conductors are further provided between the second surface of the first dielectric substrate and the first surface of the second dielectric substrate, and the two coupling line conductors and the two second line conductors are conducting individually. Plural via conductors that are filled in the plural through holes passing through the second dielectric substrate are sandwiched between and connected to the coupling line conductor and the second line conductor, respectively.

According to the present invention, it is possible to enlarge the spacing between the via conductors, thereby increasing the coupling degree K of the coupling line. When this coupler is employed for a band-pass filter, it is possible to increase the passband, and realize a high-density packaging of multiple layers.

According to aspect 17 of the present invention, there is provided a coupler comprising: a first dielectric substrate having a first surface and a second surface which are parallel to each other; a second dielectric substrate having a first surface and a second surface which are parallel to each other, the second dielectric substrate being placed on the second surface of the first dielectric substrate; a third dielectric substrate having a first surface and a second surface which are parallel to each other, the third dielectric substrate being placed on the second surface of the second dielectric substrate; a ground conductor which is formed on the first surface of the first dielectric substrate; two coupling line conductors each having a length of a ¼ wavelength, the coupling line conductors being close to each other on the second surface of the second dielectric substrate so as to be electromagnetically coupled to each other; and plural via conductors which are filled in plural through holes passing through the second dielectric substrate or the third dielectric substrate, and placed and connected to the two coupling line conductors.

According to the present invention, the opposing areas between the coupling line conductors are increased in the odd mode by an amount that is larger than an increase in the capacitance between the coupling line conductor and the ground conductor in the even mode, thereby increasing the coupling degree of the coupler.

According to aspect 18 of the present invention, in the coupler as described in aspect 17, a fourth dielectric substrate having a first surface and a second surface which are parallel to each other is formed on the second surface of the third dielectric substrate, and a ground conductor is formed on the second surface of the fourth dielectric substrate.

According to the present invention, the coupler has resistance to electromagnetic interference from outside by enclosing the coupler with the ground conductors, whereby it is possible to place the components at high densities, resulting in a miniaturized apparatus.

According to aspect 19 of the present invention, in the coupler as described in aspect 17, via conductors that are filled in through holes passing from the first dielectric substrate to the third dielectric substrate are provided, and the via conductors that are filled in the through holes passing through the three substrates short-circuit ends of the two coupling line conductors, which are not opposing each other, to the ground conductor that is formed on the first surface of the first dielectric substrate, thereby providing inter-digital coupling.

According to the present invention, it is possible to form an inter-digital filter.

According to aspect 20 of the present invention, in the coupler as described in aspect 18, via conductors that are filled in the through holes passing from the first dielectric substrate to the fourth dielectric substrate are provided, and the via conductors that are filled in the through holes passing through the four substrates short-circuit ends of the two coupling line conductors, which are not opposing each other, to the ground conductors that are formed on the first surface of the first dielectric substrate and the second surface of the fourth dielectric substrate, thereby providing inter-digital coupling.

According to the present invention, it is possible to form an inter-digital filter.

According to aspect 21 of the present invention, in the coupler as described in aspect 19 or 20, the via conductors that filled in the through holes passing through the three or four substrates short-circuit opposing ends of the two coupling line conductors to the ground conductor that is formed on the first surface of the first dielectric substrate, or to the ground conductors that are formed on the first surface of the first dielectric conductor and the second surface of the fourth dielectric substrate, thereby providing comb-line coupling.

According to the present invention, it is possible to form a comb-line filter.

According to aspect 22 of the present invention, in the coupler as described in any of aspects 19 to 21, the plural via conductors filled in the plural through holes passing through the second or third dielectric substrate are via conductors filled in the second dielectric substrate and via conductors filled in the third dielectric substrate, which are alternately placed and connected.

According to the present invention, it is possible to enlarge the spacing between the via conductors.

According to aspect 23 of the present invention, in the coupler as described in aspect 22, the plural via conductors that are filled in the plural through holes passing through the second or third dielectric substrate are placed and connected to the opposing two coupling line conductors, respectively, on a part that is closer to a line intermediate between the two coupling line conductors at regular intervals in a straight line along the length.

According to the present invention, it is possible to enlarge the spacing between the via conductors, and when the via conductors are placed in a long line at high densities, it is possible to avoid cracks due to a warp that occurs in the dielectric substrate as an insulator, especially in LTCC. Further, the opposing areas between the coupling line conductors are increased in the odd mode by an amount that is larger than an increase in the capacitance between the coupling line conductor and the ground conductor in the even mode, thereby increasing the coupling degree of the coupler.

According to aspect 24 of the present invention, in the coupler as described in any of aspects 9, 11, 14, 16, and 23, the coupler is employed as a filter.

According to the present invention, when this coupler is employed for a band-pass filter, it is possible to enlarge the width of the passband, and realize a high-density packaging of multiple layers.

According to aspect 25 of the present invention, there is provided a coupler comprising: a first dielectric substrate having a first surface and a second surface which are parallel to each other; a ground conductor which is formed on the first surface of the first dielectric substrate; two coupling line conductors each having a length of a ¼ wavelength, the coupling line conductors being close to each other on the second surface of the first dielectric substrate so as to be electromagnetically coupled to each other; and plural via dielectrics that are dielectrics having permittivities lower than that of the first dielectric substrate and being filled in plural through holes passing through the first dielectric substrate, and are placed and connected to the two coupling line conductors.

According to the present invention, it is possible to enhance the coupling degree of the coupling lines and, when this coupler is employed for a band-pass filter, it is possible to enlarge the passband, thereby realizing a high-density packaging of multiple layers.

According to aspect 26 of the present invention, in the coupler as described in aspect 25, a second dielectric substrate having a first surface and a second surface which are parallel to each other is formed on the second surface of the first dielectric substrate, and a ground conductor is formed on the second surface of the second dielectric substrate.

According to the present invention, the coupler has resistance to electromagnetic interference from outside by enclosing the coupler with the ground conductor, and it is possible to place the components at high densities, resulting in a miniaturized coupler.

According to aspect 27 of the present invention, in the coupler as described in aspect 26, plural via dielectrics that are dielectrics having permittivities lower than that of the second dielectric substrate and being filled in plural through holes passing through the second dielectric substrate are placed and connected to the two coupling line conductors.

According to the present invention, it is possible to increase the coupling degree of the coupling line and, when this coupler is employed for a band-pass filter, it is possible to enlarge the passband and realize a high-density packaging of multiple layers.

According to aspect 28 of the present invention, in the coupler as described in aspect 25, via conductors that are filled in through holes passing through the first dielectric substrate are provided, and the via conductors that are filled in the through holes passing through the substrate short-circuit ends of the two coupling line conductors, which are not opposing to each other, to the ground conductor that is formed on the first surface of the first dielectric substrate, thereby providing inter-digital coupling.

According to the present invention, it is possible to form an inter-digital filter.

According to aspect 29 of the present invention, in the coupler as described in aspect 27, via conductors that are filled in through holes passing through the first and second dielectric substrates are provided, and the via conductors that are filled in the through holes passing through the two substrates short-circuit ends of the two coupling line conductors, which are not opposing to each other, to the ground conductors that are formed on the first surface of the first dielectric substrate and the second surface of the second dielectric substrate, thereby providing inter-digital coupling.

According to the present invention, it is possible to form an inter-digital filter.

DETAILED DESCRIPTION OF THE INVENTION

Hereinafter, embodiments of the present invention will be described with reference to the drawings.

EMBODIMENT 1

Figure 1:
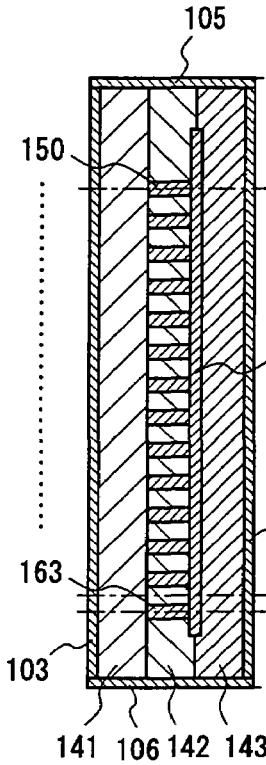
FIGS. 1(*a*)–1(*g*) are diagrams illustrating a coupler according to a first embodiment of the present invention, including longitudinal sectional views thereof (FIGS. 1(*a*) and 1(*b*)), a top plan view thereof (FIG. 1(*c*)), and transverse sectional views thereof (FIGS. 1(*d*), 1(*e*), 1(*f*), and 1(*g*)).
Figure 1:
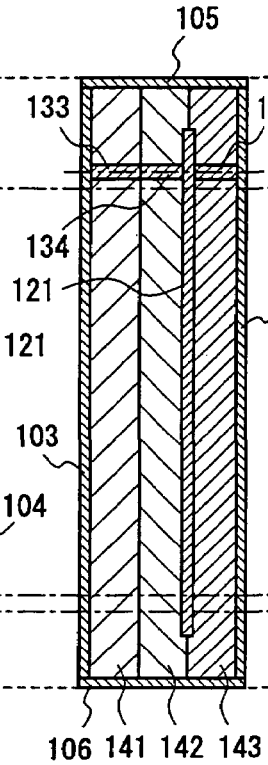
Figure 1:
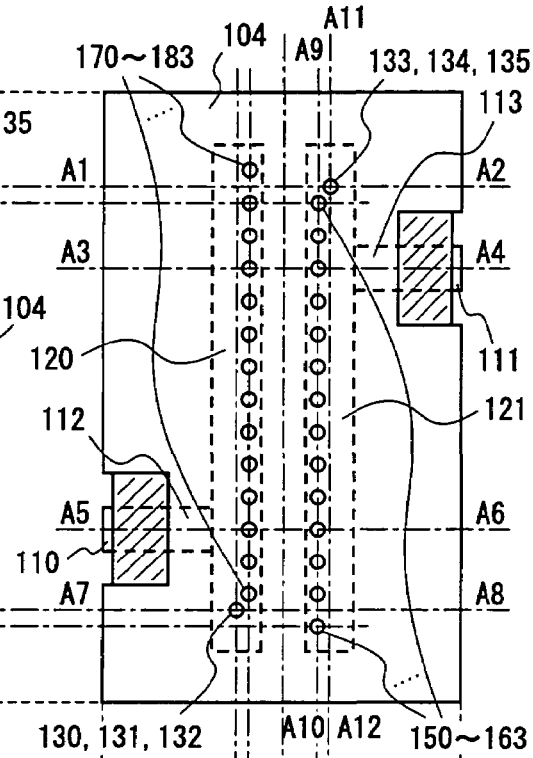
Figure 1:
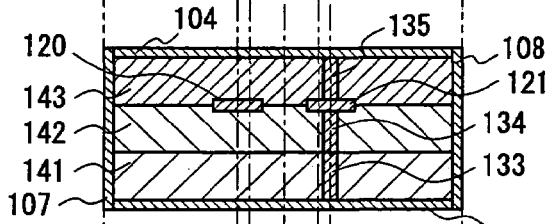
Figure 1:
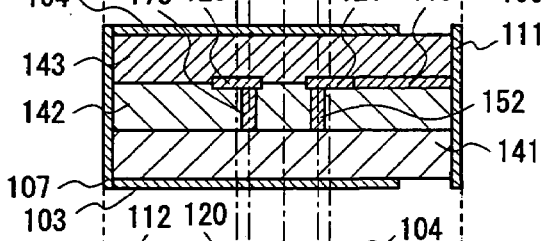
Figure 1:
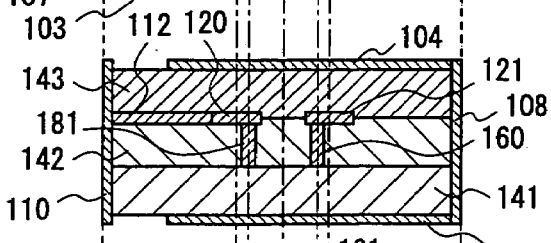
Figure 1:
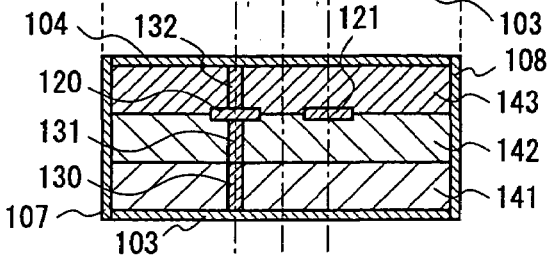

FIGS. 1(*a*)–1(*g*) are diagrams illustrating a coupler that utilizes ¼-wavelength end short-circuited type coupling lines according to a first embodiment of the present invention.

FIG. 1(*c*) is a top plan view of the coupler according to the first embodiment, in which parts that are not seen from the top are indicated by dashed lines. FIG. 1(*a*) is a longitudinal sectional view of the coupler along line A9–A10 of FIG. 1(*c*), and FIG. 1(*b*) is a longitudinal sectional view thereof along line A11–A12 of FIG. 1(*c*). FIG. 1(*d*) is a transverse sectional view of the coupler along line A1–A2 of FIG. 1(*c*), FIG. 1(*e*) is a transverse sectional view thereof along line A3–A4 of FIG. 1(*c*), FIG. 1(*f*) is a transverse sectional view thereof along line A5–A6 of FIG. 1(*c*), and FIG. 1(*g*) is a transverse sectional view thereof along line A7–A8 of FIG. 1(*c*).

As shown in FIGS. 1(*a*) and 1(*b*), first, second and third dielectric substrates 141, 142 and 143 each have a first surface (under surface) and a second surface (top surface) which are parallel to each other. The coupler according to the first embodiment has a ground conductor 103 which is formed on the under surface of the first dielectric substrate 141, and a ground conductor 104 which is formed on the top surface of the third dielectric substrate 143.

Further, as shown in FIGS. 1(*e*) and 1(*f*), between the under surface of the third dielectric substrate 143 and the top surface of the second dielectric substrate 142, there are formed signal input/output line conductors 112 and 113 that employ striplines, and two coupling line conductors 120 and 121 which are formed closely to each other so as to be electromagnetically coupled with each other and symmetrically with respect to the center line of the ground conductor 104.

In this case, the respective length along the length of the coupling line conductors 120 and 121 is a ¼ wavelength, i.e., ¼ λg (λg is an intra-tube wavelength), and the resonance is produced at this frequency.

Via conductors 130~132 and via conductors 133~135 are filled in through holes passing through the first, second and third dielectric substrates 141~143.

The via conductors 130~132 as shown in FIGS. 1(*c*) and 1(*g*), and the via conductors 133~35 as shown in FIG. 1(*b*), 1(*c*) and 1(*d*) short-circuit the not-opposing end portions of the coupling line conductors 120 and 121 to the ground conductors 104 and 103 at a position of the line A7–A8 of FIG. 1(*c*) and at a position of the line A1–A2 of FIG. 1(*c*), respectively, thereby providing inter-digital coupling.

Since the coupling line conductors 120 and 121 have the longitudinal length of a ¼-wavelength as described above, they resonate at a frequency of the ¼ wavelength and operate as a band-pass filter at the resonance frequency.

Further, on the side surfaces of the first, second and third dielectric substrates 141~143, there are formed ground conductors 105 and 106 as shown in FIGS. 1(*a*) and 1(*b*) and ground conductors 107 and 108 as shown in FIGS. 1(*d*)~1(*g*). By enclosing the coupling line conductors 120 and 121 with the ground conductors 105~108, i.e., by using striplines, it is possible to enhance a resistance to the electromagnetic interference from outside, and place the components at higher densities, thereby miniaturizing the apparatus.

The signal input/output line conductors 112 and 113 are, as shown in FIG. 1(*c*), connected to the coupling line conductors 120 and 121 so as not to be opposing each other, i.e., in a point symmetry. The input/output impedance is decided according to the distance from the connection point to the end of the coupling line conductor 120 or 121.

Further, as shown in FIGS. 1(*e*) and 1(*f*), signal input/output end face electrodes 110 and 111 at the mounting on a printed circuit board are formed on the side surfaces of the first, second, and third dielectric substrates 141~143, thereby being connected to the signal input/output line conductors 112 and 113, respectively.

Furthermore, as shown in FIG. 1(*c*), via conductors 150~163 which are filled in through holes passing through the second dielectric substrate 142 are placed on and connected to the coupling line conductor 121 as shown in FIG. 1(*a*), and similarly via conductors 170~183 which are filled in through holes passing through the second dielectric substrate 142 are placed on and connected to the coupling line conductor 120 (not shown).

Here, the via conductors 150~163 and the via conductors 170~183 are placed in such a manner that the via conductors 150~163 and the via conductors 170~183 are close and opposing each other at regular intervals in a straight line along the longitudinal direction of the coupling line conductors 120 and 121, as shown in FIGS. 1(*a*) and 1(*c*).

More specifically, as shown in FIG. 1(*c*), the via conductors 150~163 are placed along a line A9–A10 which is closer to a line intermediate between the two coupling line conductors 120 and 121 relative to the center line (line A11–A12) of the coupling line conductor 121.

That is, the via conductors 150~163 and the via conductors 170~183 are placed nearer to the line intermediate between the two coupling line conductors 120 and 121 relative to the respective center lines of the coupling line conductors 120 and 121 along the length of the coupling line conductors 120 and 121, respectively, in a straight line uniformly and at high densities, in such a manner that the respective via conductors are opposing each other.

With the above-mentioned structure, it is possible to obtain the coupler as an inter-digital filter that utilizes ¼-wavelength end short-circuited type coupling lines as shown in FIGS. 1(*a*)–1(*g*).

Next, the operation and function of the coupler that utilizes the ¼-wavelength end short-circuited coupling lines, which is constructed as described above, will be described.

In the case of a substrate using LTCC, since the length of the via conductors 150~163 and 170~183 in the vertical direction (i.e., the thickness of the dielectric substrate) is several tens to hundred microns while the thickness of the coupling line conductors 120 and 121 are several microns, the length of the via conductors 150~163 and 170~183 in the vertical direction is sufficiently larger than the thickness of the coupling line conductors 120 and 121. Accordingly, by placing the via conductors 150~163 and 170~183, opposing areas between the coupling line conductors 120 and 121 are increased in the odd mode by an amount that is larger than an increase of the capacitance C1 between the coupling line conductors 120 and 121 and the ground conductors 103~108 in the even mode, which is expressed by [Formula 1], [Formula 2], and [Formula 4], thereby increasing the capacitance C12 expressed by [Formula 1] and [Formula 4].

Therefore, as is apparent from [Formula 4], the coupler according to the first embodiment can increase the degree K of coupling of the coupling lines.

Further, when the opposing via conductors 150~163 and 170~183 are made much closer to each other, it is possible to obtain a higher degree of coupling.

As described above, according to the coupler of the first embodiment, the capacitance C12 is increased by placing and connecting the via conductors to the coupling lines, thereby increasing the degree K of coupling. When this coupler is employed for a band-pass filter, it is possible to enlarge the width of the passband, thereby realizing a high-density packaging of much more layers.

Further, according to the coupler of this first embodiment, by placing the many opposing high-density via conductors as close as possible to each other, it is possible to obtain a higher degree of coupling. The characteristics of these coupling lines can be checked using an analysis method such as a FDTD method or a finite-element method.

In this first embodiment, the coupler includes the third dielectric substrate 143 and the ground conductor 104, while the third dielectric substrate 143 and the ground conductor 104 can be eliminated to be formed by coupling lines that are composed of micro striplines.

Further, in this first embodiment, the opposing end portions of the coupling line conductors 120 and 121 may be short-circuited to the ground conductors 103 and 104 by the via conductors 130~135, thereby providing a comb-line coupling. In this case, it is possible to obtain a coupler, which is a comb-line filter utilizing ¼-wavelength end short-circuited type coupling lines.

While the via conductors 130~135 are provided in this first embodiment, it is possible to eliminate these via conductors 130~135, and use the coupling line conductors 120 and 121 for a directional coupler.

Further, in this first embodiment, the longitudinal length of the coupling line conductors 120 and 121 is a ¼ wavelength, i.e., ¼ λg (λg is an intra-tube wavelength), but it is possible to make the length shorter than ¼ λg by attaching capacitors to open ends of the coupling line conductors 120 and 121.

Further, in this first embodiment, two coupling line conductors 120 and 121 are formed symmetrically with respect to the center line of the ground conductor 104, while there is no need to form these two coupling line conductors 120 and 121 in the center of the ground conductor 104. It is possible to obtain the same performance by placing these two coupling line conductors at arbitrary positions.

EMBODIMENT 2

Figure 2:
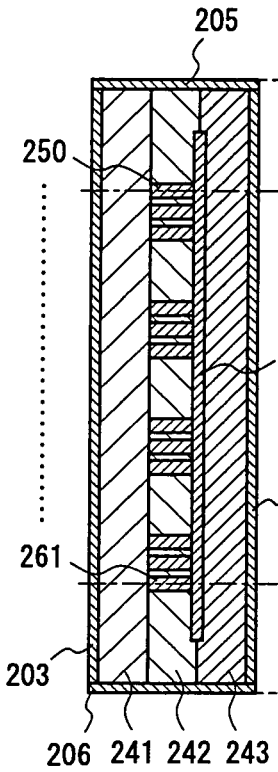
FIGS. 2(*a*)–2(*g*) are diagrams illustrating a coupler according to a second embodiment of the present invention, including longitudinal sectional views thereof (FIGS. 2(*a*) and 2(*b*)), a top plan view thereof (FIG. 2(*c*)), and transverse sectional views thereof (FIGS. 2(*d*), 2(*e*), 2(*f*), and 2(*g*)).
Figure 2:
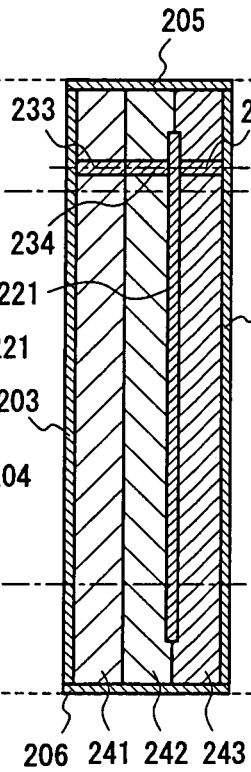
Figure 2:
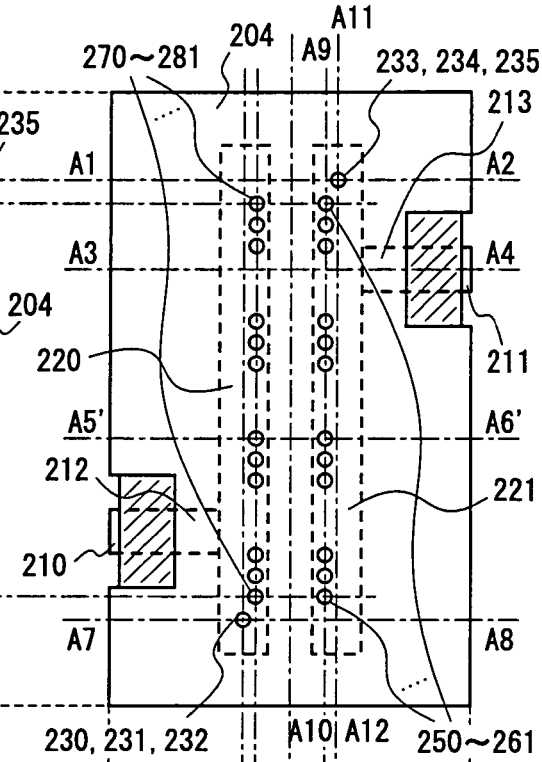
Figure 2:
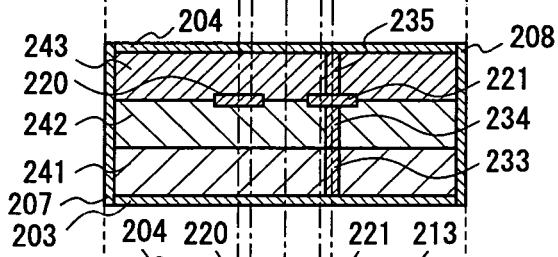
Figure 2:
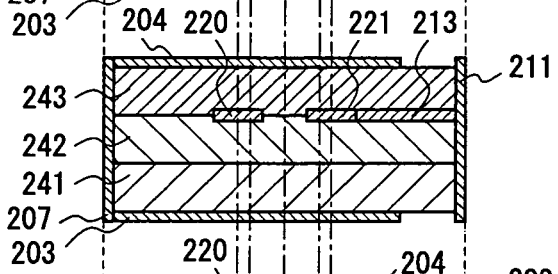
Figure 2:
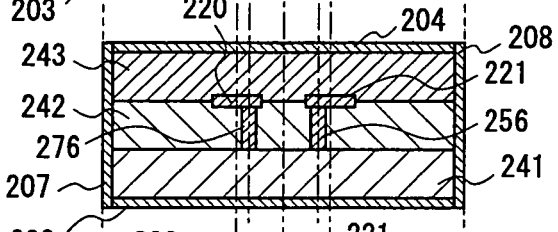
Figure 2:
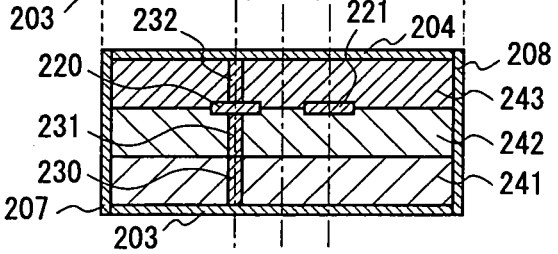

FIGS. 2(*a*)–2(*g*) are views illustrating a coupler that utilizes ¼-wavelength end short-circuited type coupling lines according to a second embodiment of the present invention. Components other than via conductors 230~232, 233~235, 250~261 and 270~281 are the same as those in the first embodiment, and their descriptions are omitted here.

FIG. 2(*c*) is a top plan view illustrating the coupler according to the second embodiment, in which parts that are not seen from the top are indicated by dashed lines. FIG. 2(*a*) is a longitudinal sectional view of the coupler along line A9–A10 of FIG. 2(*c*), and FIG. 2(*b*) is a longitudinal sectional view thereof along line A11–A12 of FIG. 2(*c*). FIG. 2(*d*) is a transverse sectional view of the coupler along line A1–A2 of FIG. 2(*c*), FIG. 2(*e*) is a transverse sectional view thereof along line A3–A4 of FIG. 2(*c*), FIG. 2(*f*) is a transverse sectional view thereof along line A5–A6 of FIG. 2(*c*), and FIG. 2(*g*) is a transverse sectional view thereof along line A7–A8 of FIG. 2(*c*).

In this second embodiment, a method of placing the via conductors 250~261 and 270~281 on the coupling line conductors 220 and 221 is different from that of the coupler according to the first embodiment. The via conductors 250~261 and 270~281 that are filled in through holes passing through the second dielectric substrate 242 are placed on and connected to the two coupling line conductors 220 and 221 intermittently and nonuniformly so as to form thin parts and dense parts.

Here, in this second embodiment, a group of plural densely-placed via conductors form a dense part, and such dense parts are placed intermittently to form a thin part between the dense parts.

More specifically, as shown in FIG. 2(*c*), among the via conductors 250~261, three via conductors, for example, 250~252, 253~255, 256~258, and 259~261 are placed densely as a group, and a large spacing is provided between these dense parts which are the groups of densely-placed via conductors.

When these via conductors are placed in a longer line at high densities, it is possible to prevent cracks due to a warp that occurs in the dielectric substrate as an insulator, particularly in LTCC.

Further, as in the first embodiment, the opposing areas between the coupling line conductors 220 and 221 are increased in the odd mode by an amount that is larger than an increase in the capacitance C1 between the coupling line conductors 220, 221 and the ground conductors 203~208 in the even mode, which is expressed by [Formula 1], [Formula 2] and [Formula 4], thereby increasing the capacitance C12 expressed by [Formula 1] and [Formula 4].

Therefore, as is apparent from [Formula 4], the coupler according to the second embodiment can increase the degree K coupling of the coupling lines.

As described above, according to the coupler of the second embodiment, since the dense parts each being composed of a group of three via conductors are intermittently placed on the two coupling line conductors, the degree K of coupling of the coupling lines is increased. When this coupler is employed for a band-pass filter, it is possible to enlarge the passband, and achieve a high-density packaging of multiple layers.

EMBODIMENT 3

Figure 3:
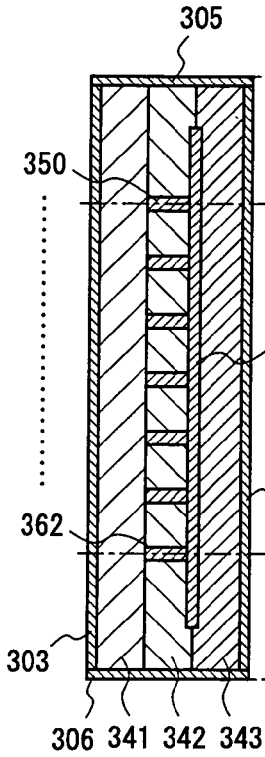
FIGS. 3(*a*)–3(*g*) are diagrams illustrating a coupler according to a third embodiment of the present invention, including longitudinal sectional views thereof (FIGS. 3(*a*) and 3(*b*)), a top plan view thereof (FIG. 3(*c*)), and transverse sectional views thereof (FIGS. 3(*d*), 3(*e*), 3(*f*), and 3(*g*)).
Figure 3:
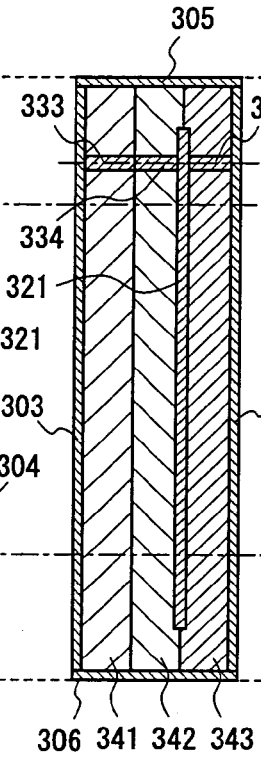
Figure 3:
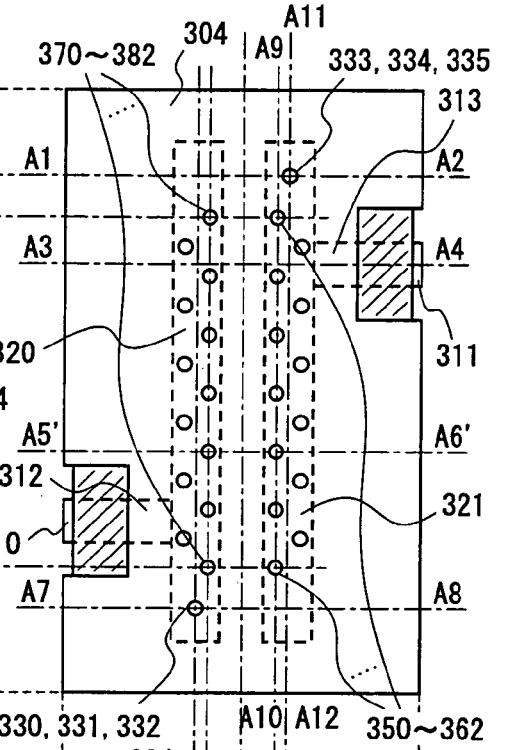
Figure 3:
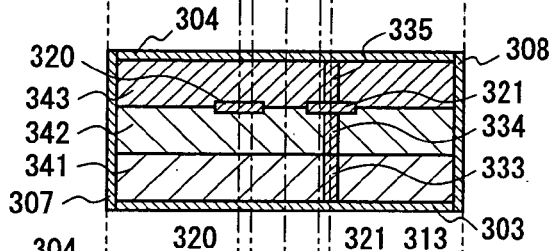
Figure 3:
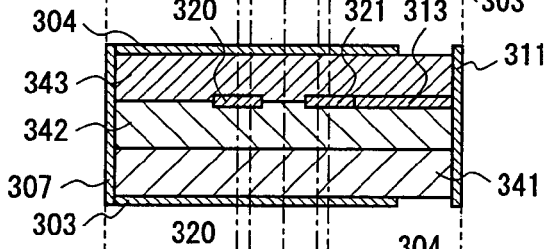
Figure 3:
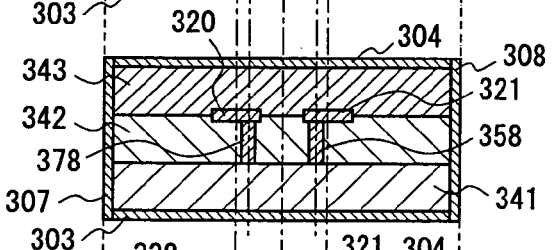
Figure 3:
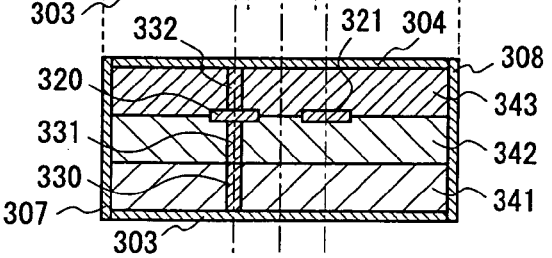

FIGS. 3(*a*)–3(*g*) are diagrams illustrating a coupler that utilizes ¼-wavelength end short-circuited type coupling lines according to a third embodiment of the present invention. Components other than via conductors 330~332, 333~335, 350~362, and 370~382 are the same as those in the first embodiment, and their descriptions are omitted here.

FIG. 3(*c*) is a top plan view of the coupler according to the third embodiment, in which parts that are not shown from the top are indicated by dashed lines. FIG. 3(*a*) is a longitudinal sectional view of the coupler along line A9–A10 of FIG. 3(*c*), and FIG. 3(*b*) is a longitudinal sectional view thereof along line A11–A12 of FIG. 3(*c*). FIG. 3(*d*) is a transverse sectional view of the coupler along line A1–A2 of FIG. 3(*c*), FIG. 3(*e*) is a transverse sectional view thereof along line A3–A4 of FIG. 3(*c*), FIG. 3(*f*) is a transverse sectional view thereof along line A5–A6 of FIG. 3(*c*), and FIG. 3(*g*) is a transverse sectional view thereof along line A7–A8 of FIG. 3(*c*).

In the coupler according to the third embodiment, a method of placing the via conductors 350~362 and 370~382 on the coupling line conductors 320 and 321 is different from that in the first embodiment. The via conductors 350~362 and 370~382 that are filled in through holes passing through the second dielectric substrate 342 are placed on and connected to two coupling line conductors 320 and 321, respectively, so that the via conductors are opposing each other in a zigzag manner.

According to the third embodiment, as shown in FIG. 3(*c*), the via conductors 350~362 and 370~382 are placed on the coupling line conductors 320 and 321, respectively, in a staggered manner, so that the via conductors 350~362 and 370~382 which are respectively placed on the coupling line conductor 320 and 321 are opposing each other.

When the via conductors are placed in the staggered manner as described above, it is possible to enlarge a spacing between the via conductors. When the via conductors are placed in a longer line at higher densities, it is possible to prevent cracks due to a warp that occurs on the dielectric substrate as an insulator, particularly in LTCC.

Further, since as in the first embodiment the opposing areas between the coupling line conductors 320 and 321 are increased in the odd mode by an amount that is larger than an increase of the capacitance C1 between the coupling line conductors 320, 321 and the ground conductors 303~308 in the even mode, which is expressed by [Formula 1], [Formula 2], and [Formula 4], the capacitance C12 that is expressed by [Formula 1] and [Formula 4] is increased.

Therefore, as is apparent from [Formula 4], the coupler according to the third embodiment can increase the degree K of coupling of the coupling lines.

As described above, according to the coupler of the third embodiment, as the via conductors are placed in a staggered manner, it is possible to enlarge the spacing between the via conductors and accordingly increase the coupling degree K of the coupling lines. When this coupler is employed for a band-pass filter, the passband can be enlarged, and high-density packaging of multiple layers can be realized.

EMBODIMENT 4

Figure 4:
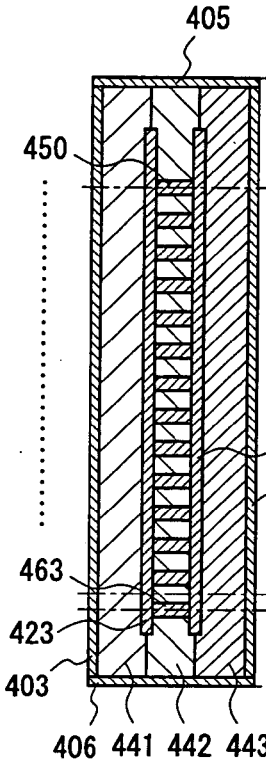
FIGS. 4(*a*)–4(*g*) are diagrams illustrating a coupler according to a fourth embodiment of the present invention, including longitudinal sectional views thereof (FIGS. 4(*a*) and 4(*b*)), a top plan view thereof (FIG. 4(*c*)), and transverse sectional views thereof (FIGS. 4(*d*), 4(*e*), 4(*f*), and 4(*g*)).
Figure 4:
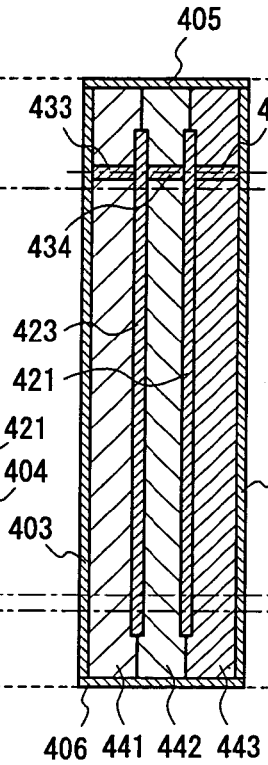
Figure 4:
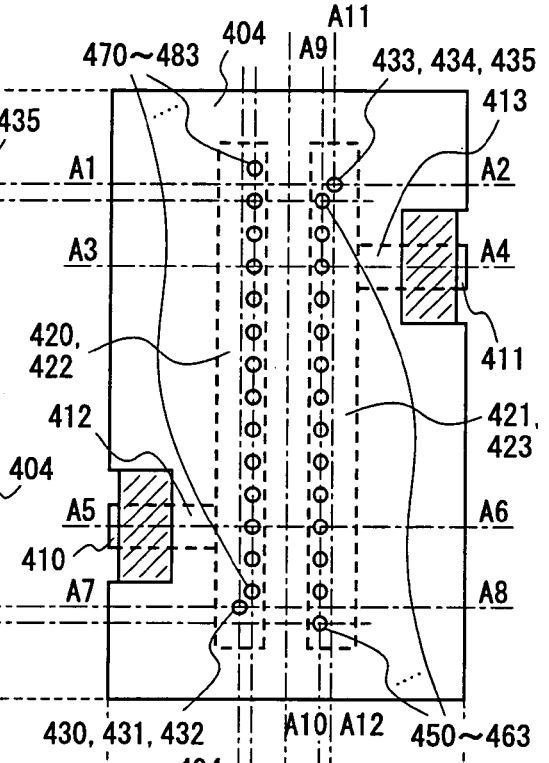
Figure 4:
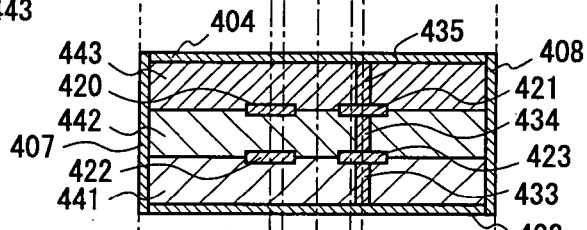
Figure 4:
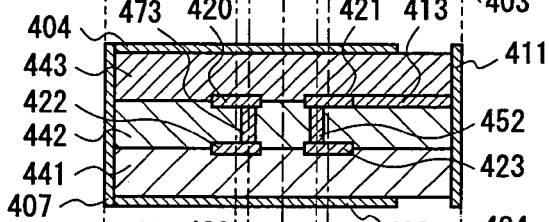
Figure 4:
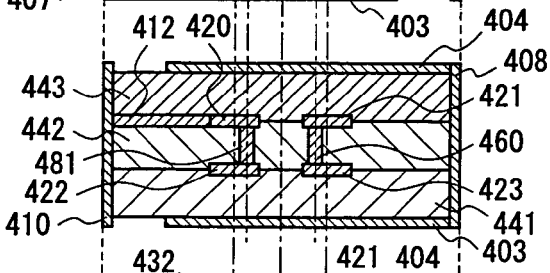
Figure 4:
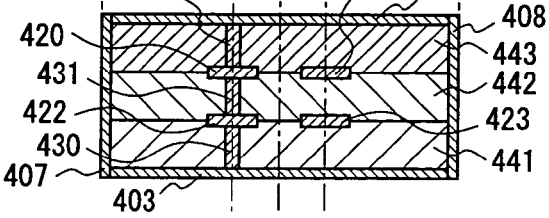

FIGS. 4(*a*)–4(*g*) are diagrams illustrating a coupler that utilizes ¼-wavelength end short-circuited type coupling lines according to a fourth embodiment of the present invention. Components other than via conductors 430~432, 433~435, 450~463 and 470~483, and second line conductors 422 and 423 are the same as those in the first embodiment, and their descriptions are omitted here.

FIG. 4(*c*) is a top plan view illustrating the coupler according to the fourth embodiment, in which parts that are not seen from the top are indicated by dashed lines. FIG. 4(*a*) is a longitudinal sectional view of the coupler along line A9–A10 of FIG. 4(*c*), and FIG. 4(*b*) is a longitudinal sectional view thereof along line A11–A12 of FIG. 4(*c*). FIG. 4(*d*) is a transverse sectional view of the coupler along line A1–A2 of FIG. 4(*c*), FIG. 4(*e*) is a transverse sectional view thereof along line A3–A4 of FIG. 4(*c*), FIG. 4(*f*) is a transverse sectional view thereof along line A5–A6 of FIG. 4(*c*), and FIG. 4(*g*) is a transverse sectional view thereof along line A7–A8 of FIG. 4(*c*).

In the fourth embodiment, in contrast to the first embodiment, two second line conductors 422 and 423 are formed between the under surface of the second dielectric substrate 442 and the top surface of the first dielectric substrate 441, and the two coupling line conductors 421 and 420 and the two second line conductors 422 and 423 are conducting, respectively.

Further, in this fourth embodiment, as shown in FIGS. 4(*d*) ~4(*g*), the second line conductors 422 and 423 are placed between the under surface of the second dielectric substrate 442 and the top surface of the first dielectric substrate 441, in parallel to the coupling line conductors 420 and 421, respectively.

Further, the via conductors 450~463 and 470~483 that are filled in through holes passing through the second dielectric substrate 442 are sandwiched between and connected to the second line conductors 422, 423 and the coupling line conductors 420, 421, respectively.

The via conductors 450~463 and the via conductors 470~483 are placed at regular intervals in such a manner that they are close to each other and opposing each other as shown in FIG. 4(*c*), like in the first embodiment.

It is possible to obtain a larger spacing between the via conductors by placing the via conductors, the coupling line conductors, and the second line conductors in this way. Furthermore, it is possible to prevent cracks due to a warp that occurs on the dielectric substrate as an insulator by placing the via conductors in a long line at high densities, particularly in LTCC.

Further, like in the first embodiment, since the opposing areas between the coupling line conductors 420 and 421 are increased in the odd mode by an amount that is larger than an increase of the capacitance C1 in the even mode between the coupling line conductors 420, 421 and the ground conductors 403~408, which is expressed by [Formula 1],

[Formula 2], and [Formula 4], the capacitance C12 that is expressed by [Formula 1] and [Formula 4] is increased.

Therefore, as is apparent from [Formula 4], the coupler according to the fourth embodiment can increase the degree K of coupling of the coupling lines.

As described above, according to the coupler of the fourth embodiment, since two coupling line conductors and two second line conductors are conducting, respectively, and plural via conductors that are filled in plural through holes passing through the second dielectric substrate are sandwiched between and connected to the coupling line conductors and the second line conductors, it is possible to obtain a large spacing between the via conductors, and thus increase the degree K of coupling of the coupling lines. When this coupler is employed for a band-pass filter, the passband can be enlarged, and high-density packaging of multiple layers can be realized.

EMBODIMENT 5

Figure 5:
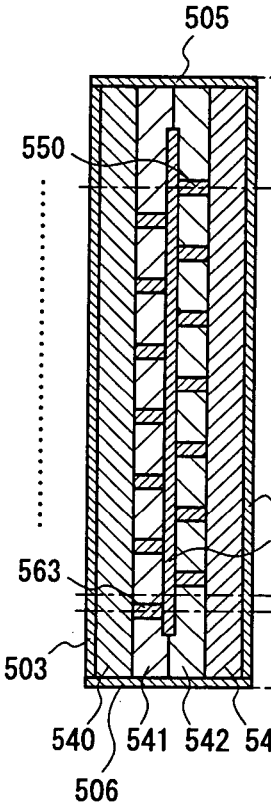
FIGS. 5(*a*)–5(*g*) are diagrams illustrating a coupler according to a fifth embodiment of the present invention, including longitudinal sectional views thereof (FIGS. 5(*a*) and 5(*b*)), a top plan view thereof (FIG. 5(*c*)), and transverse sectional views thereof (FIGS. 5(*d*), 5(*e*), 5(*f*), and 5(*g*)).
Figure 5:
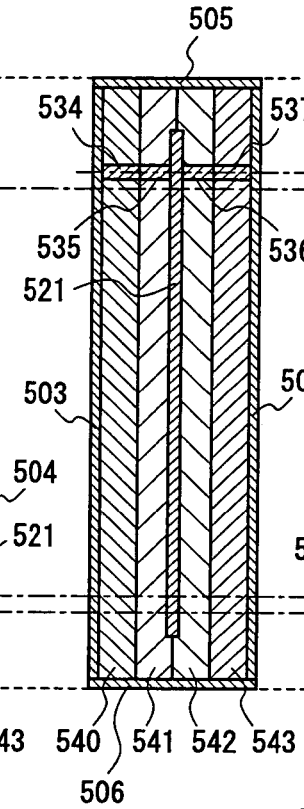
Figure 5:
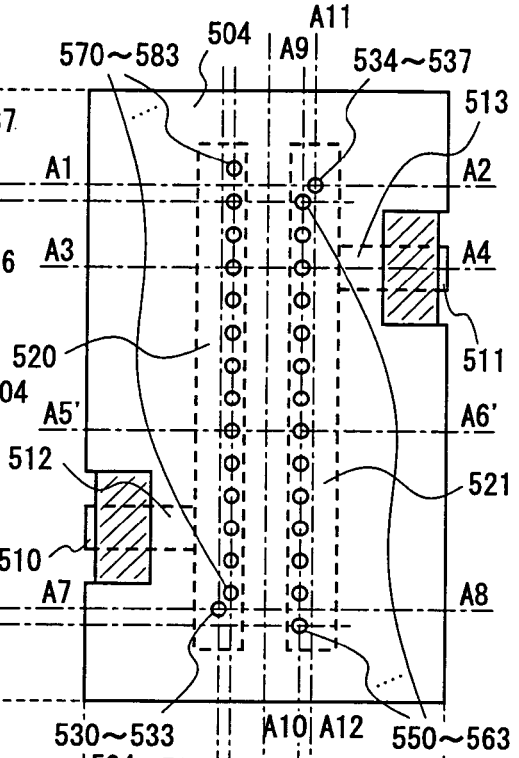
Figure 5:
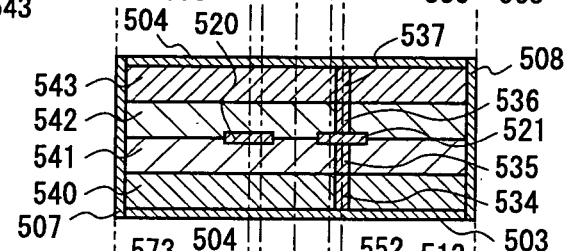
Figure 5:
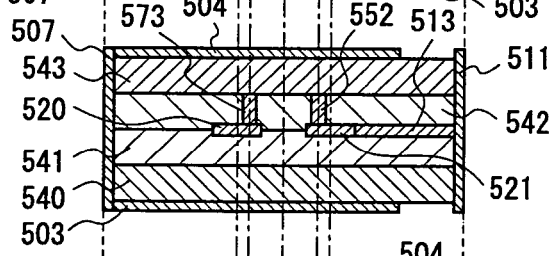
Figure 5:
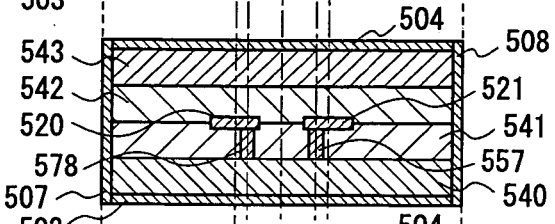
Figure 5:
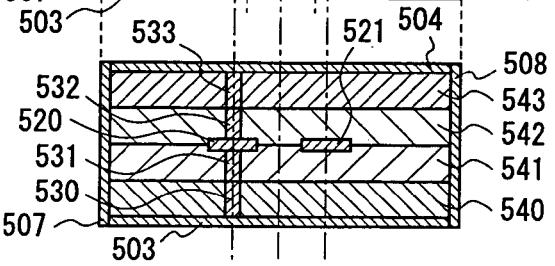

FIGS. 5(*a*)–5(*g*) are diagrams illustrating a coupler that utilizes ¼-wavelength end short-circuited type coupling lines according to a fifth embodiment of the present invention. Components other than via conductors 530~533, 534~537, 550~563 and 570~583, and a fourth dielectric substrate 543 are the same as those in the first embodiment, and their descriptions are omitted here.

FIG. 5(*c*) is a top plan view illustrating the coupler according to the fifth embodiment, in which parts that are not seen from the top are indicated by dashed lines. FIG. 5(*a*) is a longitudinal sectional view of the coupler along line A9–A10 of FIG. 5(*c*), and FIG. 5(*b*) is a longitudinal sectional view thereof along line A11–A12 of FIG. 5(*c*). FIG. 5(*d*) is a transverse sectional view of the coupler along line A1–A2 of FIG. 5(*c*), FIG. 5(*e*) is a transverse sectional view thereof along line A3–A4 of FIG. 5(*c*), FIG. 5(*f*) is a transverse sectional view thereof along line A5–A6 of FIG. 5(*c*), and FIG. 5(*g*) is a transverse sectional view thereof along line A7–A8 of FIG. 5(*c*).

According to the fifth embodiment, in contrast to the first embodiment, a fourth dielectric substrate 543 having a first surface (under surface) and a second surface (top surface) which are parallel to each other is formed on the second surface of the third dielectric substrate 542, and the ground conductor 504 is formed on the second surface of the fourth dielectric substrate 543. Then, via conductors for increasing the coupling degree are formed in two layers, i.e., in the second and third dielectric substrates 541 and 542, respectively.

In this fifth embodiment, as shown in FIGS. 5(*a*) and 5(*c*), via conductors that are filled in through holes passing through the second dielectric substrate 541 and via conductors that are filled in through holes passing through the third dielectric substrate 542 are alternately placed on and connected to the coupling line conductors 520 and 521.

That is, among the via conductors 550~563, the via conductors 550, 552, 554, 556, 558, 560 and 562 in the third dielectric substrate 542 and the via conductors 551, 553, 555, 557, 559, 561 and 563 in the second dielectric substrate 541 are alternately placed on the coupling line conductor 521 along the length, as well as, among the via conductors 570~583, the via conductors 571, 573, 575, 577, 579, 581 and 583 in the third dielectric substrate 542 and the via conductors 570, 572, 574, 576, 578, 580 and 582 in the second dielectric substrate 541 are alternately placed on the coupling line conductor 520 along the length.

As the via conductors and the dielectric substrates are placed in the above-mentioned manner, it is possible to enlarge a spacing between the via conductors. Furthermore, when the via conductors are placed in a long line at high densities, it is possible to avoid cracks due to a warp that occurs in the dielectric substrate as an insulator, especially in LTCC.

Further, as in the first embodiment, since the opposing areas between the coupling line conductors 520 and 521 are increased in the odd mode by an amount that is larger than an increase in the capacitance C1 between the coupling line conductors 520, 521 and the ground conductors 503~508 in the even mode, which is expressed by [Formula 1], [Formula 2], and [Formula 4], the capacitance C12 as expressed by [Formula 1] and [Formula 4] is accordingly increased.

Therefore, as is apparent from [Formula 4], the coupler according to the fifth embodiment can increase the coupling degree K of the coupling lines.

As described above, according to the coupler of the fifth embodiment, four layers of the dielectric substrates are provided, and via conductors are formed alternately in two layers of the second and third dielectric substrates along the respective two coupling line conductors, whereby it is possible to enlarge the spacing between the via conductors and thus increase the coupling degree K of the coupling lines. When this coupler is employed for a band-pass filter, the passband can be enlarged, and it is possible to realize a high-density packaging of multiple layers.

EMBODIMENT 6

Figure 6:
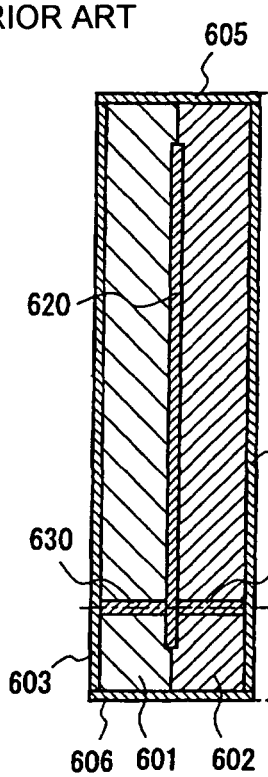
Fig.6 (a) PRIOR ART
FIGS. 6(*a*)–6(*g*) are diagrams illustrating a conventional coupler, including longitudinal sectional views thereof (FIGS. 6(*a*) and 6(*b*)), a top plan view thereof (FIG. 6(*c*)), and transverse sectional views thereof (FIGS. 6(*d*), 6(*e*), 6(*f*), and 6(*g*)).
Figure 6:
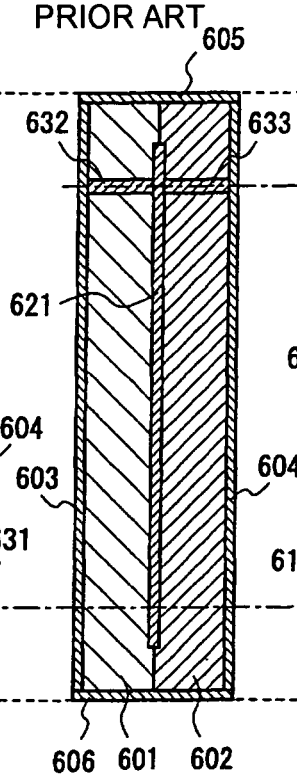
Fig.6 (b) PRIOR ART
Figure 6:
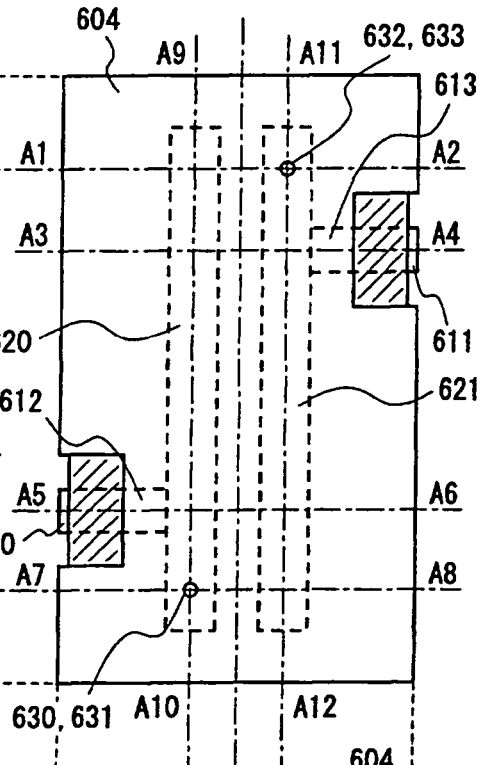
Fig.6 (b) PRIOR ART
Figure 6:
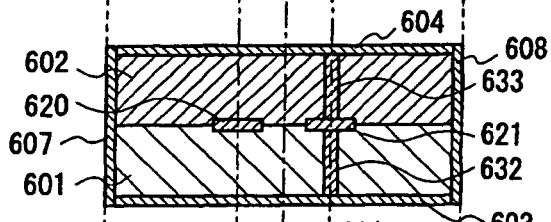
Fig.6 (d) PRIOR ART
Figure 6:
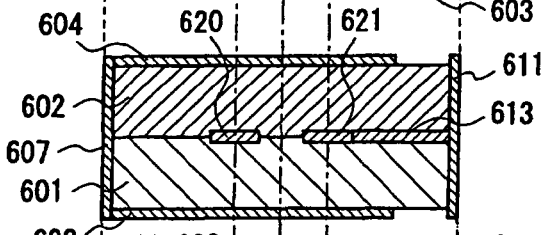
Fig.6 (e) PRIOR ART
Figure 6:
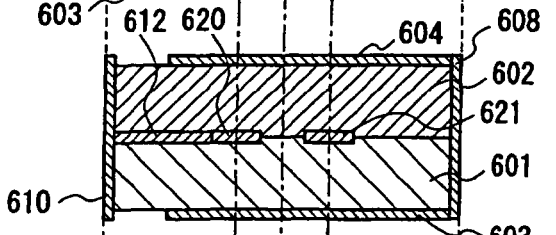
Fig.6 (f) PRIOR ART
Figure 6:
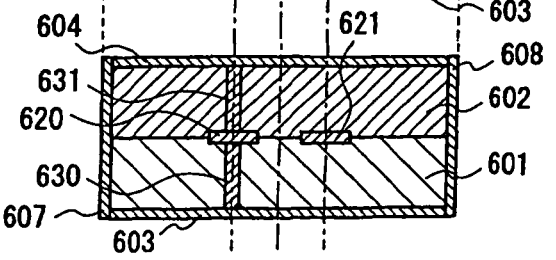
Fig.6 (g) PRIOR ART
Figure 7:
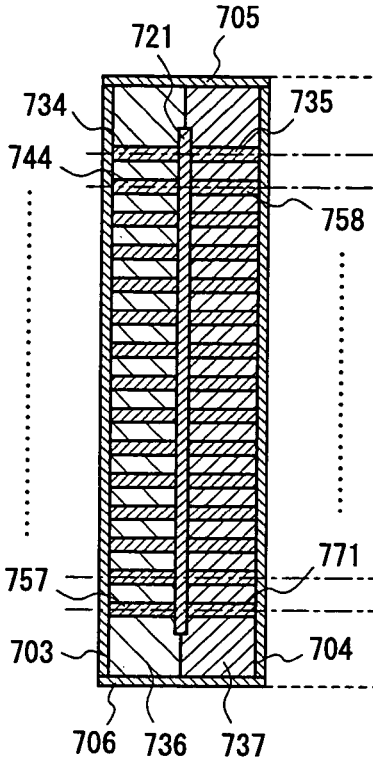
FIGS. 7(*a*)–7(*f*) are diagrams illustrating a coupler according to a sixth embodiment of the present invention, including longitudinal sectional views thereof (FIGS. 7(*a*)), a top plan view thereof (FIG. 7(*b*)), and transverse sectional views thereof (FIGS. 7(*c*), 7(*d*), 7(*e*), and 7(*f*)).
Figure 7:
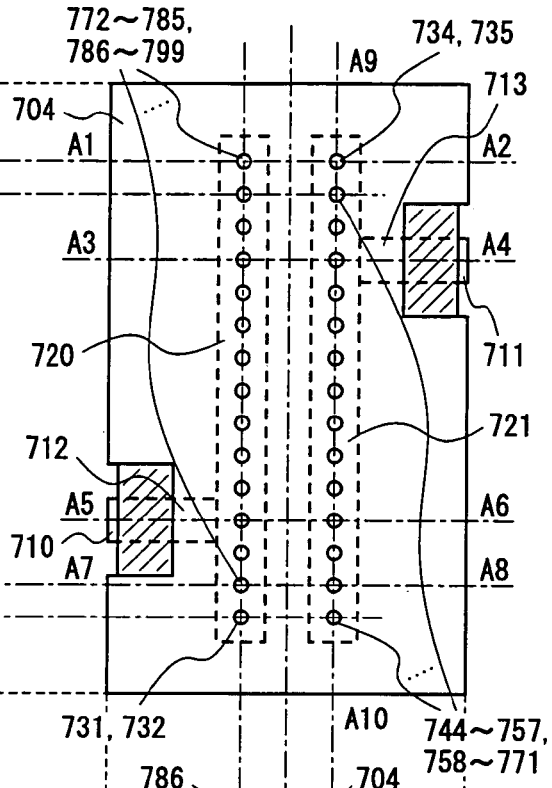
Figure 7:
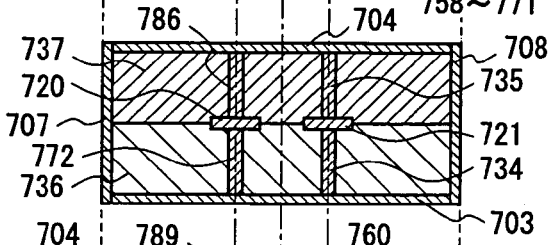
Figure 7:
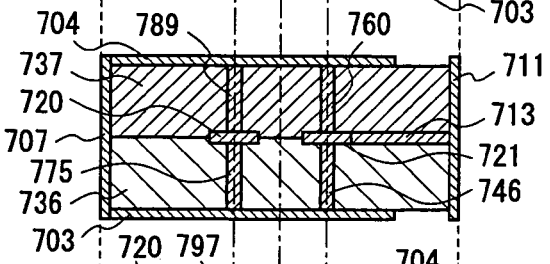
Figure 7:
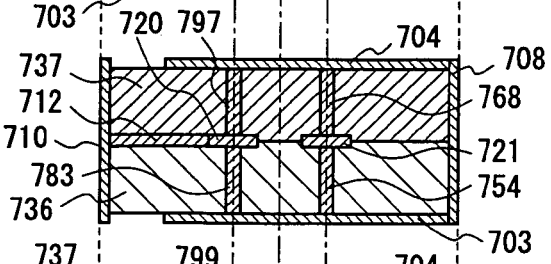
Figure 7:
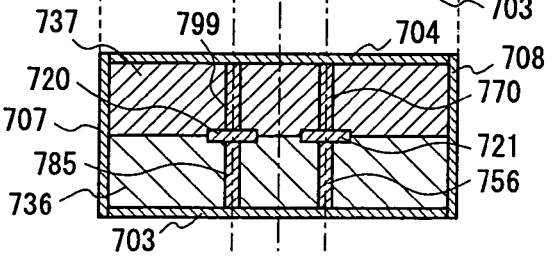

FIGS. 7(*a*)–7(*f*) are diagrams illustrating a coupler that utilizes ¼-wavelength end short-circuited type coupling lines according to a sixth embodiment of the present invention. Here, components other than via dielectrics 744~757 and 786~799 are the same as those in the prior art of FIG. 6, and their descriptions are omitted here.

FIG. 7(*b*) is a top plan view illustrating the coupler according to the sixth embodiment, in which parts that are not seen from the top are indicated by dashed lines. FIG. 7(*a*) is a longitudinal sectional view of the coupler along line A9–A10 of FIG. 7(*b*). FIG. 7(*c*) is a transverse sectional view of the coupler along line A1–A2 of FIG. 7(*b*), FIG. 7(*d*) is a transverse sectional view thereof along line A3–A4 of FIG. 7(*b*), FIG. 7(*e*) is a transverse sectional view thereof along line A5–A6 of FIG. 7(*b*), and FIG. 7(*f*) is a transverse sectional view thereof along line A7–A8 of FIG. 7(*b*).

In this sixth embodiment, in contrast to the prior art, via dielectrics for increasing the coupling degree are formed in two layers of first and second dielectric substrates 736 and 737, respectively.

In the sixth embodiment, as shown in FIGS. 7(*a*) and 7(*b*), via dielectrics 744~757 and 772~785 that are dielectrics having permittivities which are lower than that of the first dielectric substrate 736, being filled in through holes passing through the first dielectric substrate 736, and via dielectrics 758~771 and 786~799 that are dielectrics having permittivities which are lower than that of the second dielectric substrate 737, being filled in through holes passing through the second dielectric substrate 737 are placed on and connected to the coupling line conductors 720 and 721.

Further, as in the first embodiment, the capacitance C1 between the coupling line conductors 720, 721 and the ground conductors 703~708, which is expressed by [Formula 1], [Formula 2], and [Formula 4], becomes small in the even mode, while the capacitance C12 between the coupling line conductors 720 and 721 in the odd mode, which is expressed by [Formula 1] and [Formula 4], is not changed.

Therefore, as is apparent from [Formula 4], the coupler according to the sixth embodiment can increase the coupling degree K of the coupling lines.

As described above, according to the coupler of the sixth embodiment, via dielectrics that are dielectrics having permittivities which are lower than that of the dielectric substrate are filled in two layers of the first and second dielectric substrates along two coupling line conductors, respectively, whereby it is possible to enhance the coupling degree K of the coupling lines. When this coupler is employed for a band-pass filter, it is possible to enlarge the passband, and realize a high-density packaging of multiple layers.

INDUSTRIAL AVAILABILITY

As described above, the coupler according to the present invention is suitable for a directional coupler in a microwave circuit or a coupler that is used for a filter, especially for a coupler that utilizes striplines.

The invention claimed is:

1. A coupler comprising:

a first dielectric substrate having a first surface and a second surface which are parallel to each other;

a second dielectric substrate having a first surface and a second surface which are parallel to each other, said second dielectric substrate being placed on said second surface of said first dielectric substrate;

a third dielectric substrate having a first surface and a second surface which are parallel to each other, said third dielectric substrate being placed on said second surface of said second dielectric substrate;

a ground conductor on said first surface of said first dielectric substrate;

two coupling line conductors each having a length of a ¼ wavelength, said coupling line conductors being close to each other on said second surface of said second dielectric substrate so as to be electromagnetically coupled to each other;

plural via conductors filled in plural through holes passing through said second dielectric substrate or said third dielectric substrate, and placed and connected to said two coupling line conductors; and via conductors filled in through holes passing from said first dielectric substrate to said third dielectric substrate, and said via conductors in said through holes passing through said three substrates are arranged to make opposing ends of said two coupling line conductors short-circuit to said ground conductor on each of said first dielectric substrate, thereby providing comb-line coupling.

2. The coupler as defined in claim 1, wherein said plural via conductors filled in said plural through holes passing through said second or said third dielectric substrate are via conductors filled in said second dielectric substrate and via conductors filled in said third dielectric substrate, which are alternately placed and connected.

3. The coupler as defined in claim 2, wherein said plural via conductors filled in said plural through holes passing through said second or said third dielectric substrate are placed and connected to said opposing two coupling line conductors, respectively, on a part that is closer to a line intermediate between said two coupling line conductors at regular intervals in a straight line along length thereof.

4. A coupler comprising:

a first dielectric substrate having a first surface and a second surface which are parallel to each other;

a second dielectric substrate having a first surface and a second surface which are parallel to each other, said second dielectric substrate being placed on said second surface of said first dielectric substrate;

a ground conductor on said first surface of said first dielectric substrate;

two coupling line conductors each having a length of a ¼ wavelength, said coupling line conductors being close to each other on said second surface of said second dielectric substrate so as to be electromagnetically coupled to each other;

a third dielectric substrate having a first surface and a second surface which are parallel to each other, said third dielectric substrate being placed on said second surface of said second dielectric substrate;

a ground conductor on said second surface of said third dielectric substrate;

plural via conductors filled in plural through holes passing through said second dielectric substrate, said via conductors being placed and connected to said two coupling line conductors; and via conductors filled in through holes passing from said first dielectric substrate to said third dielectric substrate, and said via conductors filled in said through holes passing through said three substrates are arranged to make ends of said two coupling line conductors, which are not opposing each other, short-circuit to said ground conductor on each of said first surface of said first dielectric substrate and said second surface of said third dielectric substrate, thereby providing inter-digital coupling.

5. A coupler comprising:

a first dielectric substrate having a first surface and a second surface which are parallel to each other;

a second dielectric substrate having a first surface and a second surface which are parallel to each other, said second dielectric substrate being placed on said second surface of said first dielectric substrate;

a ground conductor on said first surface of said first dielectric substrate;

two coupling line conductors each having a length of a ¼ wavelength, said coupling line conductors being close to each other on said second surface of said second dielectric substrate so as to be electromagnetically coupled to each other;

plural via conductors filled in plural through holes passing through said second dielectric substrate, said via conductors being placed and connected to said two coupling line conductors; and via conductors filled in through holes passing from said first dielectric substrate to said second dielectric substrate, and said via conductors filled in said through holes passing through said two substrates are arranged to make ends of said two coupling line conductors, which are not opposing each other, short-circuit to said ground conductor on said first surface of said first dielectric substrate, thereby providing inter-digital coupling.

6. The coupler as defined in claim 4 wherein said plural via conductors filled in said plural through holes passing through said second dielectric substrate are placed and connected to said two coupling line conductors at regular intervals.

7. The coupler as defined in claim 4 wherein said plural via conductors filled in said plural through holes passing through said second dielectric substrate are placed and connected to said two coupling line conductors in a straight line along a length thereof.

8. The coupler as defined in claim 4 wherein said plural via conductors filled in said plural through holes passing through said second dielectric substrate are placed and connected to said opposing two coupling line conductors, respectively, on a part which is closer to a line intermediate between said two coupling line conductors.

9. The coupler as defined in claim 4 wherein said plural via conductors filled in said plural through holes passing through said second dielectric substrate are placed and connected to said opposing two coupling line conductors, respectively, on a part which is closer to a line intermediate between said two coupling line conductors at regular intervals in a straight line along the length.

10. The coupler as defined in claim 4 wherein said plural via conductors filled in said plural through holes passing through said second dielectric substrate are placed and connected to said two coupling line conductors so as to form thin parts and dense parts.

11. The coupler as defined in claim 4 wherein said plural via conductors filled in said plural through holes passing through said second dielectric substrate are placed and connected to said two coupling line conductors in such a manner that dense parts each being composed of a group of said via conductors are placed intermittently.

12. The coupler as defined in claim 11 wherein said plural via conductors filled in said plural through holes passing through said second dielectric substrate are placed and connected to said opposing two coupling line conductors, respectively, on a part which is closer to a line intermediate between said two coupling line conductors in a straight line along a length thereof.

13. The coupler as defined in claim 4, wherein said plural via conductors filled in said plural through holes passing through said second dielectric substrate are placed and connected to said two coupling line conductors in a zigzag manner so that said via conductors are opposing each other.

14. The coupler as defined in claim 4 wherein said plural via conductors filled in said plural through holes passing through said second dielectric substrate are placed and connected to said two coupling line conductors in a staggered manner so that said via conductors are opposing each other.

15. The coupler as defined in claim 4 further comprising:

two second line conductors between said second surface of said first dielectric substrate and said first surface of said second dielectric substrate, and said two coupling line conductors and said two second line conductors are shaped and arranged to conduct individually, and plural via conductors filled in the plural through holes passing through said second dielectric substrate are sandwiched between and connected to said coupling line conductor and said second line conductor, respectively.

16. The coupler as defined in claim 9 further comprising:

two second line conductors between said second surface of said first dielectric substrate and said first surface of said second dielectric substrate, and said two coupling line conductors and said two second line conductors are shaped and arranged to conduct individually, and plural via conductors filled in said plural through holes passing through said second dielectric substrate are sandwiched between and connected to said coupling line conductor and said second line conductor, respectively.

17. A coupler comprising:

a first dielectric substrate having a first surface and a second surface which are parallel to each other;

a second dielectric substrate having a first surface and a second surface which are parallel to each other, said second dielectric substrate being placed on said second surface of said first dielectric substrate;

a third dielectric substrate having a first surface and a second surface which are parallel to each other, said third dielectric substrate being placed on said second surface of said second dielectric substrate;

a ground conductor on said first surface of said first dielectric substrate;

two coupling line conductors each having a length of a ¼ wavelength, said coupling line conductors being close to each other on said second surface of said second dielectric substrate so as to be electromagnetically coupled to each other;

plural via conductors filled in plural through holes passing through said second dielectric substrate or said third dielectric substrate, and placed and connected to said two coupling line conductors; and via conductors filled in through holes passing from said first dielectric substrate to said third dielectric substrate, and said via conductors filled in said through holes passing through said three substrates are arranged to make ends of said two coupling line conductors, which are not opposing each other, short-circuit to said ground conductor on said first surface of said first dielectric substrate, thereby providing inter-digital coupling.

18. The coupler as defined in claim 9, said coupler being employed as a filter.

19. A coupler comprising:

a first dielectric substrate having a first surface and a second surface which are parallel to each other;

a second dielectric substrate having a first surface and a second surface which are parallel to each other, said second dielectric substrate being placed on said second surface of said first dielectric substrate;

a third dielectric substrate having a first surface and a second surface which are parallel to each other, said third dielectric substrate being placed on said second surface of said second dielectric substrate;

a ground conductor on said first surface of said first dielectric substrate;

two coupling line conductors each having a length of a /1;4wavelength, said coupling line conductors being close to each other on said second surface of said second dielectric substrate so as to be electromagnetically coupled to each other;

plural via conductors filled in plural through holes passing through said second dielectric substrate or said third dielectric substrate, and placed and connected to said two coupling line conductors; and via conductors filled in through holes passing from said first dielectric substrate to said third dielectric substrate, and said via conductors filled in said through holes passing through said three substrates are arranged to make ends of said two coupling line conductors, which are not opposing each other, short-circuit to said ground conductor on said first surface of said first dielectric substrate, thereby providing inter-digital coupling.

20. The coupler as defined in claim 17, further comprising:

via conductors filled in said through holes passing from said first dielectric substrate to said fourth dielectric substrate, and said via conductors filled in said through holes passing through said four substrates are arranged to make ends of said two coupling line conductors, which are not opposing each other, short-circuit to said ground conductors on said first surface of said first dielectric substrate and said second surface of said fourth dielectric substrate, thereby providing inter-digital coupling.

21. The coupler as defined in claim 18, wherein said plural via conductors filled in said plural through holes passing through said second or said third dielectric substrate are via conductors filled in said second dielectric substrate and via conductors filled in said third dielectric substrate, which are alternately placed and connected.

22. The coupler as defined in claim 19 wherein said plural via conductors filled in said plural through holes passing through said second or said third dielectric substrate are placed and connected to said opposing two coupling line conductors, respectively, on a part that is closer to a line intermediate between said two coupling line conductors at regular intervals in a straight line along length thereof.

23. The coupler as defined in claim 20, said coupler being employed as a filter.

24. A coupler comprising:

a first dielectric substrate having a first surface and a second surface which are parallel to each other;

a ground conductor on said first surface of said first dielectric substrate;

two coupling line conductors each having a length of a ¼ wavelength, said coupling line conductors being close to each other on said second surface of said first dielectric substrate so as to be electromagnetically coupled to each other; and plural via dielectrics having permittivities lower than that of said first dielectric substrate and being filled in plural through holes passing through said first dielectric substrate, said via dielectrics being placed and connected to said two coupling line conductors.

25. The coupler as defined in claim 23 further comprising:

via conductors filled in through holes passing through said first dielectric substrate, and said via conductors filled in said through holes passing through said substrate are arranged to make ends of said two coupling line conductors, which are not opposing each other, short-circuit to said ground conductor on said first surface of said first dielectric substrate, thereby providing inter-digital coupling.

26. The coupler as defined in claim 23 further comprising:

a second dielectric substrate having a first surface and a second surface which are parallel to each other, said second dielectric substrate being placed on said second surface of said first dielectric substrate, and a ground conductor on said second surface of said second dielectric substrate.

27. The coupler as defined in claim 25 further comprising:

plural via dielectrics having permittivities lower than that of said second dielectric substrate and being filled in plural through holes passing through said second dielectric substrate, said via dielectrics being placed and connected to said two coupling line conductors.

28. The coupler as defined in claim 26 further comprising:

via conductors filled in through holes passing through said first and said second dielectric substrates, and said via conductors filled in said through holes passing through said two substrates are arranged to make ends of said two coupling line conductors, which are not opposing to each other, short circuit to said ground conductors on said first surface of said first dielectric substrate and said second surface of said second dielectric substrate, thereby providing inter-digital coupling.

29. A coupler comprising:

a first dielectric substrate having a first surface and a second surface which are parallel to each other;

a second dielectric substrate having a first surface and a second surface which are parallel to each other, said second dielectric substrate being placed on said second surface of said first dielectric substrate;

a ground conductor on said first surface of said first dielectric substrate;

two coupling line conductors each having a length of a /1;4wavelength, said coupling line conductors being close to each other on said second surface of said second dielectric substrate so as to be electromagnetically coupled to each other;

plural via conductors filled in plural through holes passing through said second dielectric substrate, said via conductors being placed and connected to said two coupling line conductors; and via conductors filled in through holes passing from said first dielectric substrate to said second dielectric substrate, and said via conductors filled in said through holes passing through said two substrates short-circuit opposing ends of said two coupling line conductors to said ground conductor on said first surface of said first dielectric substrate, thereby providing comb-line coupling.

30. The coupler as defined in claim 29, further comprising:

two second line conductors between said second surface of said first dielectric substrate and said first surface of said second dielectric substrate, and said two coupling line conductors and said two second line conductors are shaped and arranged to conduct individually, and plural via conductors filled in the plural through holes passing through said second dielectric substrate are sandwiched between and connected to said coupling line conductor and said second line conductor, respectively.

31. The coupler as defined in Claim 29, wherein said plural via conductors filled in said plural through holes passing through said second dielectric substrate are placed and connected to said two coupling line conductors at regular intervals.

32. The coupler as defined in Claim 29, wherein said plural via conductors filled in said plural through holes passing through said second dielectric substrate are placed and connected to said two coupling line conductors in a straight line along a length thereof.

33. The coupler as defined in Claim 29, wherein said plural via conductors filled in said plural through holes passing through said second dielectric substrate are placed and connected to said opposing two coupling line conductors, respectively, on a part which is closer to a line intermediate between said two coupling line conductors.

34. The coupler as defined in Claim 29, wherein said plural via conductors filled in said plural through holes passing through said second dielectric substrate are placed and connected to said opposing two coupling line conductors, respectively, on a part which is closer to a line intermediate between said two coupling line conductors at regular intervals in a straight line along the length.

35. The coupler as defined in Claim 29, wherein said plural via conductors filled in said plural through holes passing through said second dielectric substrate are placed and connected to said two coupling line conductors so as to form thin parts and dense parts.

36. The coupler as defined in Claim 29, wherein said plural via conductors filled in said plural through holes passing through said second dielectric substrate are placed and connected to said two coupling line conductors in such a manner that dense parts each being composed of a group of said via conductors are placed intermittently.

37. The coupler as defined in Claim 36, wherein said plural via conductors filled in said plural through holes passing through said second dielectric substrate are placed and connected to said opposing two coupling line conductors, respectively, on a part which is closer to a line intermediate between said two coupling line conductors in a straight line along a length thereof.

38. The coupler as defined in Claim 29, wherein said plural via conductors filled in said plural through holes passing through said second dielectric substrate are placed and connected to said two coupling line conductors in a zigzag manner so that said via conductors are opposing each other.

39. The coupler as defined in Claim 29, wherein said plural via conductors filled in said plural through holes passing through said second dielectric substrate are placed and connected to said two coupling line conductors in a staggered manner so that said via conductors are opposing each other.

* * * * *